US011046552B2

(12) United States Patent
Sudi et al.

(10) Patent No.: US 11,046,552 B2
(45) Date of Patent: Jun. 29, 2021

(54) METHOD AND SYSTEM OF REDUCING FALSE ACTUATION OF SAFETY BRAKES IN ELEVATOR SYSTEM

(71) Applicant: OTIS ELEVATOR COMPANY, Farmington, CT (US)

(72) Inventors: Sandeep Sudi, Farmington, CT (US); Joseph Crute, Cromwell, CT (US); Arthur T. Grondine, Deep River, CT (US); Randall S. Dube, Glastonbury, CT (US); Daryl J. Marvin, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 547 days.

(21) Appl. No.: 15/966,929

(22) Filed: Apr. 30, 2018

(65) Prior Publication Data

US 2019/0300331 A1 Oct. 3, 2019

Related U.S. Application Data

(60) Provisional application No. 62/648,628, filed on Mar. 27, 2018.

(51) Int. Cl.

| | |
|---|---|
| ***B66B 1/32*** | (2006.01) |
| ***B66B 5/04*** | (2006.01) |
| ***B66B 5/06*** | (2006.01) |
| ***B66B 5/00*** | (2006.01) |

(52) U.S. Cl.

CPC ..... *B66B 1/32* (2013.01); *B66B 5/0037* (2013.01); *B66B 5/048* (2013.01); *B66B 5/06* (2013.01)

(58) Field of Classification Search

CPC ..... B66B 1/32; B66B 5/0037; B66B 5/048; B66B 5/06; B66B 5/18; B66B 5/16; B66B 5/0031

See application file for complete search history.

(56) References Cited

U.S. PATENT DOCUMENTS

| | | | |
|---|---|---|---|
| 5,495,919 | A | 3/1996 | Ericson et al. |
| 5,526,901 | A | 6/1996 | Salmon |
| 5,869,794 | A | 2/1999 | Spiess |
| 6,253,879 | B1 | 7/2001 | Skalski et al. |
| 8,939,262 | B2 | 1/2015 | Schienda et al. |
| 9,776,827 | B2 | 10/2017 | Harkonen et al. |
| 2008/0128217 | A1 | 6/2008 | Kattainen et al. |
| 2010/0140023 | A1 | 6/2010 | Fukui et al. |

(Continued)

FOREIGN PATENT DOCUMENTS

| | | | |
|---|---|---|---|
| DE | 10150284 | A1 | 4/2003 |
| EP | 1298083 | A1 | 4/2003 |

(Continued)

OTHER PUBLICATIONS

European Search Report for application EP 1165633.9, dated Feb. 19, 2020, 75 pages.

*Primary Examiner* — Jeffrey Donels
(74) *Attorney, Agent, or Firm* — Cantor Colburn LLP

(57) ABSTRACT

A method of avoiding unnecessary safety brake actuation in an elevator system. The method includes determining whether a true overspeed or overacceleration condition of an elevator car is present. The method also includes activating the electronic safety actuator if a true overspeed or overacceleration condition of the elevator car.

20 Claims, 3 Drawing Sheets

(56) References Cited

U.S. PATENT DOCUMENTS

| | | | | |
|---|---|---|---|---|
| 2012/0000729 | A1* | 1/2012 | Marvin | B66B 5/044 187/287 |
| 2012/0000731 | A1* | 1/2012 | Schienda | B66B 5/06 187/305 |
| 2012/0000732 | A1* | 1/2012 | Draper | B66B 5/06 187/373 |
| 2013/0098711 | A1* | 4/2013 | Aguado | B66B 5/18 187/373 |
| 2014/0367206 | A1 | 12/2014 | Della Porta et al. | |
| 2016/0145074 | A1 | 5/2016 | Kattainen et al. | |
| 2017/0073190 | A1 | 3/2017 | Dube | |
| 2019/0010024 | A1* | 1/2019 | Kattainen | B66B 5/0031 |

FOREIGN PATENT DOCUMENTS

| | | | |
|---|---|---|---|
| EP | 2408703 | A1 | 1/2012 |
| EP | 2848568 | A1 | 3/2015 |
| EP | 3225578 | A1 | 10/2017 |

* cited by examiner

METHOD AND SYSTEM OF REDUCING FALSE ACTUATION OF SAFETY BRAKES IN ELEVATOR SYSTEM

CROSS-REFERENCE TO RELATED APPLICATION

This application claims the benefit of U.S. Patent Application 62/648,628 filed Mar. 27, 2018, which is incorporated herein by reference in its entirety.

BACKGROUND

The disclosure relates generally to elevator systems and, more particularly, to a method and system of reducing false actuation of elevator safety brakes.

Although safeties are key components of an elevator system, unwanted actuation causes an operational nuisance due to a shutdown period that may ensue. False engagement of safeties and/or false actuation of the car overspeed governor overspeed (OS) switch can arise from e-stops, or unintended motion in the elevator car due to inertial impulses. This may occur due to people jumping in the elevator car or a counterweight jump, for example. Either type of jump could be just high enough to cause a momentary increase in elevator car velocity, causing operation system switch actuation and is accompanied by or is followed by actual safety engagement. Operation system switch actuation refers to an overspeed governor overspeed switch in some situations. Resolution of the issue may require a mechanic to visit the site for resetting and rescue of passengers.

BRIEF SUMMARY

Disclosed is a method of avoiding unnecessary safety brake actuation in an elevator system. The method includes determining whether a true overspeed or overacceleration condition of an elevator car is present. The method also includes activating the electronic safety actuator if a true overspeed or overacceleration condition of the elevator car.

In addition to one or more of the features described above, or as an alternative, further embodiments may include obtaining data with at least one sensor associated with an electronic safety actuator. Also included is monitoring various operating conditions of the elevator car. Further included is determining if the electronic safety actuator was activated during the various operating conditions. Yet further included is determining if activation of the electronic safety actuator was a false trip. Also included is updating a data model based on the determination of whether the activation was a false trip.

In addition to one or more of the features described above, or as an alternative, further embodiments may include that the data obtained by the at least one sensor is velocity data.

In addition to one or more of the features described above, or as an alternative, further embodiments may include that the velocity data is compared to a threshold velocity to determine if the threshold velocity is exceeded or if the threshold velocity is exceeded for a predetermined period of time.

In addition to one or more of the features described above, or as an alternative, further embodiments may include that the data obtained by the at least one sensor is acceleration data.

In addition to one or more of the features described above, or as an alternative, further embodiments may include that the acceleration data is compared to a threshold acceleration to determine if the safety brake should be applied.

In addition to one or more of the features described above, or as an alternative, further embodiments may include that the threshold acceleration must be exceeded for a predetermined period of time.

Also disclosed is a method of avoiding unnecessary safety brake actuation in an elevator system. The method includes determining whether a true overspeed or overacceleration condition of an elevator car is present. The method also includes avoiding activation of the electronic safety actuator if a true overspeed or overacceleration condition of the elevator car is not present.

In addition to one or more of the features described above, or as an alternative, further embodiments may include obtaining data with at least one sensor associated with an electronic safety actuator. Also included is monitoring various operating conditions of the elevator car. Further included is determining if the electronic safety actuator was activated during the various operating conditions. Yet further included is determining if activation of the electronic safety actuator was a false trip. Also included is updating a data model based on the determination of whether the activation was a false trip.

In addition to one or more of the features described above, or as an alternative, further embodiments may include that the data obtained by the at least one sensor is velocity data and the threshold condition is a threshold velocity.

In addition to one or more of the features described above, or as an alternative, further embodiments may include that the velocity data is compared to a threshold velocity to determine if the threshold velocity is exceeded or if the threshold velocity is exceeded for a predetermined period of time.

In addition to one or more of the features described above, or as an alternative, further embodiments may include that the data obtained by the at least one sensor is acceleration data and the threshold condition is a threshold acceleration.

In addition to one or more of the features described above, or as an alternative, further embodiments may include that analyzing the data obtained with the at least one sensor is conducted at a remote site, the at least one sensor in operative communication with a processing device at the remote site.

In addition to one or more of the features described above, or as an alternative, further embodiments may include that analyzing the data obtained with the at least one sensor is conducted on site by an individual.

Further disclosed is a method of avoiding inadvertent resetting of a safety brake of an elevator system. The method includes obtaining data with at least one sensor associated with an electronic safety actuator. The method also includes determining whether resetting of a safety brake is made based on an algorithm that compares the data obtained by the sensor(s) and a threshold condition, resetting of the safety brake occurring if the threshold condition is exceeded for equal to or greater than a predetermined amount of time.

In addition to one or more of the features described above, or as an alternative, further embodiments may include that the data obtained by the at least one sensor is velocity data and the threshold condition is a threshold velocity.

In addition to one or more of the features described above, or as an alternative, further embodiments may include that the data obtained by the at least one sensor is acceleration data and the threshold condition is a threshold acceleration.

In addition to one or more of the features described above, or as an alternative, further embodiments may include analyzing the data obtained with the at least one sensor. Also included is modifying the algorithm based on actual use of the safety brake.

In addition to one or more of the features described above, or as an alternative, further embodiments may include that analyzing the data obtained with the at least one sensor is conducted at a remote site, the at least one sensor in operative communication with a processing device at the remote site.

In addition to one or more of the features described above, or as an alternative, further embodiments may include that analyzing the data obtained with the at least one sensor is conducted on site by an individual.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
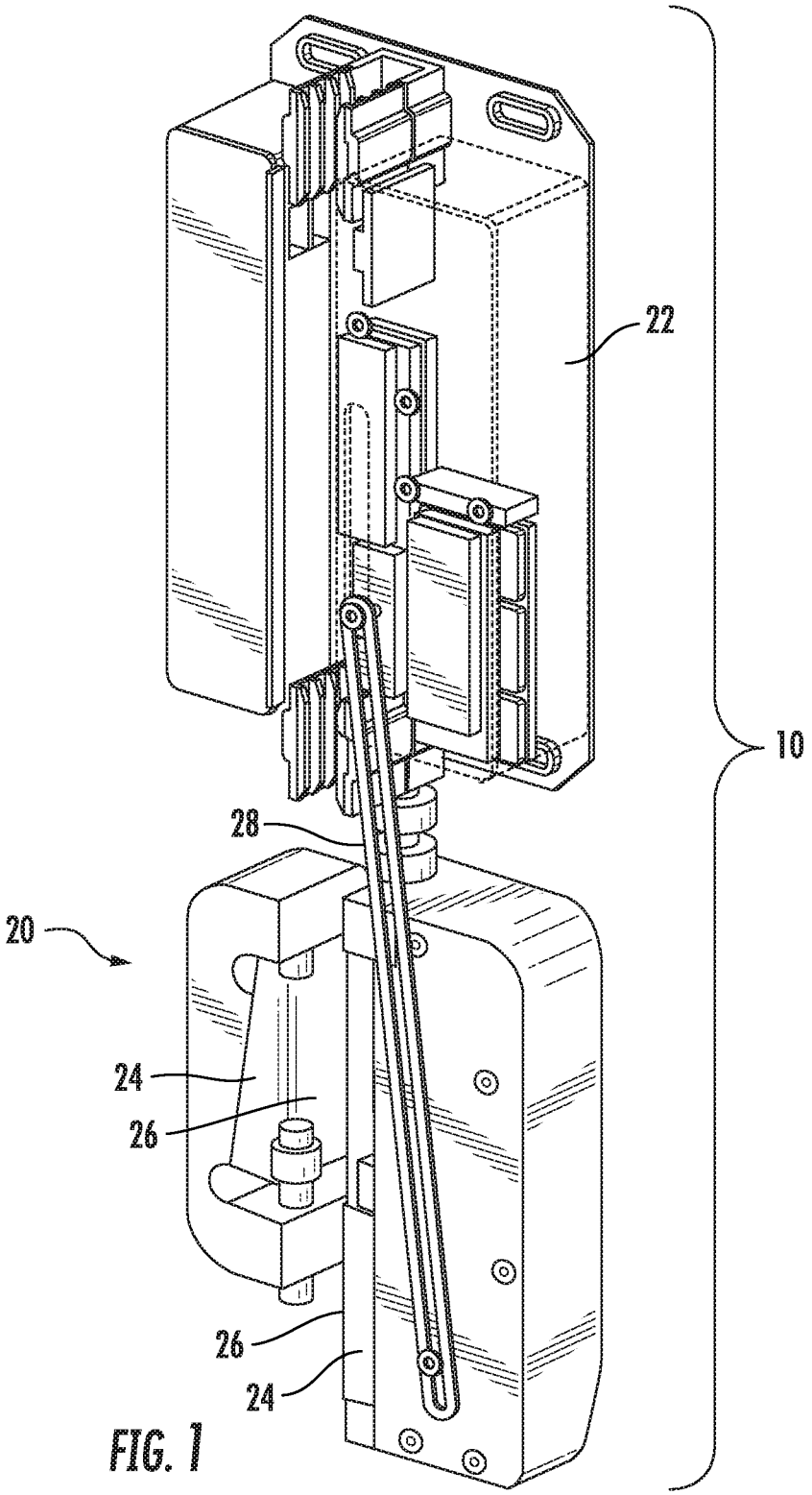
FIG. 1 is a perspective view of an elevator braking system.
Figure 2:
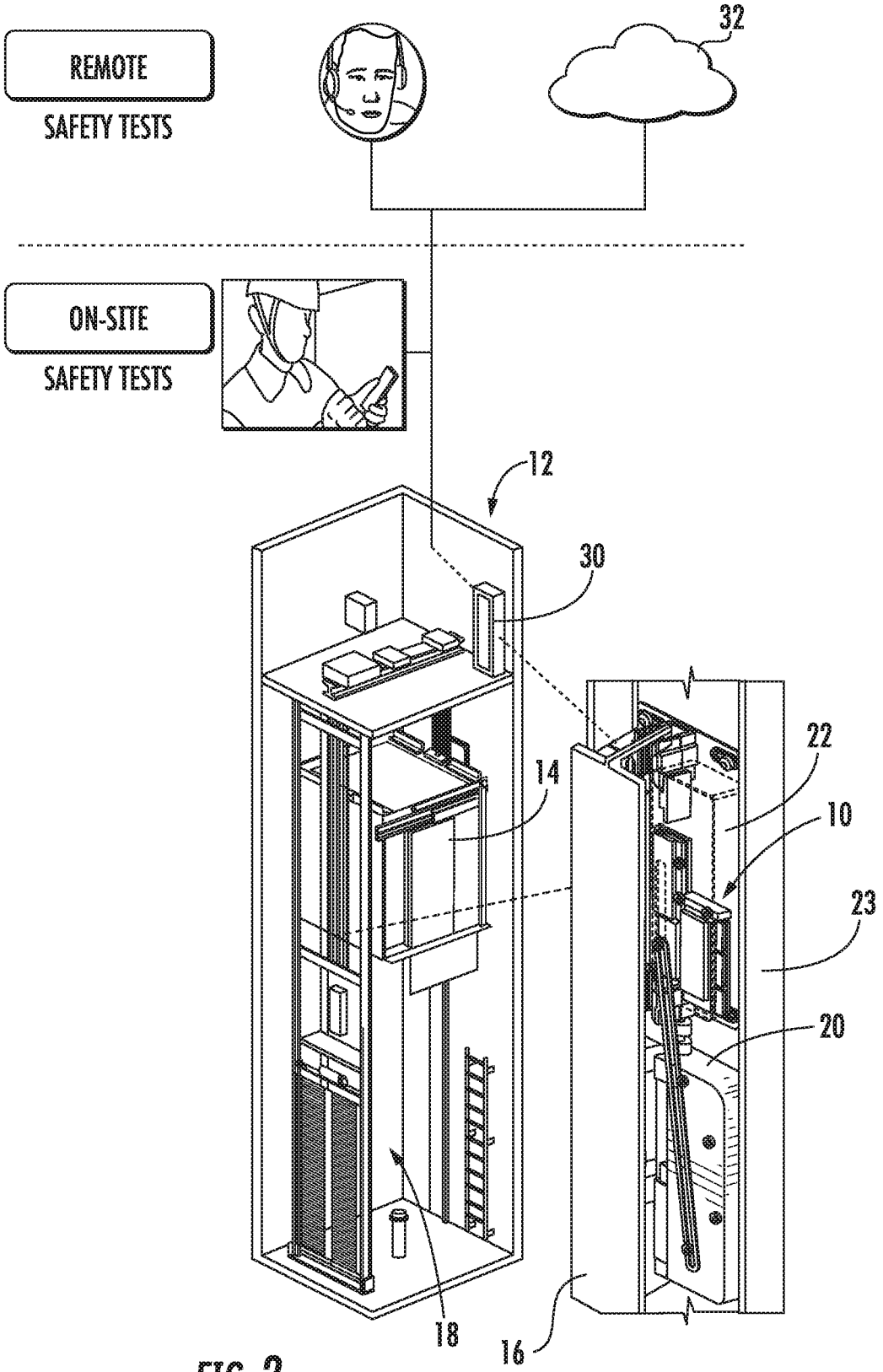
FIG. 2 is a schematic view of an elevator system.

FIGS. 1 and 2 illustrate a brake assembly 10 for an elevator system 12, with FIG. 1 showing the broader elevator system 12 and FIG. 1 depicting an enlarged portion of FIG. 1, specifically the brake assembly 10. The elevator system includes an elevator car 14 that moves through an elevator car passage 18 (e.g., hoistway). The elevator car 14 is guided by one or more guide rails 16 connected to a sidewall of the elevator car passage 18. The embodiments described herein relate to an overall braking system that is operable to assist in braking (e.g., slowing or stopping movement) of the elevator car 14. In one embodiment, the braking is performed relative to the guide rail 16. The brake assembly 10 can be used with various types of elevator systems.

The brake assembly 10 includes a safety brake 20 and an electronic safety actuator 22 that are each operatively coupled to the elevator car 14. In some embodiments, the safety brake 20 and the electronic safety actuator 22 are mounted to a car frame 23 of the elevator car 14. The safety brake 20 includes a brake member 24, such as a brake pad or a similar structure suitable for repeatable braking engagement, with the guide rail 16. The brake member 24 has a contact surface 26 that is operable to frictionally engage the guide rail 16. In one embodiment, the safety brake 20 and an electronic safety actuator 22 may be combined into a single unit.

The safety brake 20 is operable between a non-braking position and a braking position. The non-braking position is a position that the safety brake 20 is disposed in during normal operation of the elevator car 14. In particular, the contact surface 26 of the brake member 24 is not in contact with, or is in minimal contact with, the guide rail 16 while in the non-braking position, and thus does not frictionally engage the guide rail 16. In the braking position, the frictional force between the contact surface 26 of the brake member 24 and the guide rail 16 is sufficient to stop movement of the elevator car 14 relative to the guide rail 16. Various triggering mechanisms or components may be employed to actuate the safety brake 20 and thereby move the contact surface 26 of the brake member 24 into frictional engagement with the guide rail 16. In the illustrated embodiment, a link member 28 is provided and couples the electronic safety actuator 22 and the safety brake 20. Movement of the link member 28 triggers movement of the brake member 24 of the safety brake 20 from the non-braking position to the braking position.

In operation, an electronic sensing device and/or a controller 30 is configured to monitor various parameters and conditions of the elevator car 14 and to compare the monitored parameters and conditions to at least one predetermined condition. In one embodiment, the predetermined condition comprises speed and/or acceleration of the elevator car 14. In the event that the monitored condition (e.g., speed, acceleration, etc.) meets or exceeds the predetermined condition, the electronic safety actuator 22 is actuated to facilitate engagement of the safety brake 20 and the guide rail 16. In some embodiments, the electronic safety actuator 22 has a velocity sensor and an accelerometer. Data is analyzed by the controller and/or the electronic safety actuator 22 to determine if there is an overspeed or overacceleration condition. If such a condition is detected, the electronic safety actuator 22 activates, thereby pulling up on the link member 28 and driving the contact surface 26 of the brake member 24 into frictional engagement with the guide rail 16—applying the brake(s). In some embodiments, the electronic safety actuator 22 sends this data to the elevator controller 30 and the controller sends it back to the electronic safety actuator 22 and tells it to activate.

In an embodiment, two electronic safety actuators 22 (one on each guide rail) are provided and connected to a controller on the elevator car 14 that gets data from the electronic safety actuators 22 and initiates activation of the electronic safety actuators 22 for synchronization purposes. In further embodiments, each electronic safety actuator 22 decides to activate on its own. Still further, one electronic safety actuator 22 may be "smart" and one is "dumb," where the smart electronic safety actuator gathers the speed/acceleration data and sends a command to the dumb one to activate along with the smart electronic safety actuator. The illustrated safety brake 20 and safety actuator 22 are merely examples of designs that may be employed in the embodiments described herein and it is to be understood that alternative designs may be utilized.

The embodiments described herein reduce the likelihood of a false trip of the safety brake 20 by utilizing the electronic safety actuator 22 which is electronically monitored and controlled. A false trip refers to actuation of the safety brake 20 by the electronic safety actuator 22 in response to a perceived overspeed or overacceleration condition that is not a true overspeed or overacceleration condition. For example, movement or jumping of passengers within the elevator car 14 may result in such a perceived, but not actual threat. Numerous other examples may result in false trip, including any impulsive movement of the elevator car 14, the counterweight, or other elevator system equipment. The embodiments described herein provide a method of discerning between a false trip and a true overspeed or overacceleration condition by starting with basic theoretical algorithms (also referred to herein as "data model(s)") that filter out events known to cause false trips and may dynamically modify the algorithms during actual use over time by "learning" from events known to be a true overspeed or overacceleration condition or a false trip. These embodiments provide improvements over rigidly defined settings that strictly adhere to a rated condition, as will be appreciated from the description herein.

Monitoring and/or control of the electronic safety actuator 22 is facilitated with wired or wireless communication between the controller 30 and the electronic safety actuator 22. In one embodiment, the electronic safety actuator may directly connect over a cellular, Bluetooth, or any other wireless connection to a processing device, such as the controller 30, a mechanic's service tool (such as a mobile phone, tablet, laptop, or dedicated service tool), a remote computer, or a cloud server, for example, and monitoring and/or control may be handled by the connected device. The monitoring and/or control of the electronic safety actuator 22 may be carried out by manual command by an individual located in close or remote proximity to the brake assembly 10 and/or the controller 30. In one embodiment, the monitoring and/or control may be carried out automatically by the controller 30, a cloud server, or other remote computing device. An individual is considered in proximity to the brake assembly 10 when the individual is able to physically interact with the brake assembly 10 and/or the controller 30. Interaction with the brake assembly 10 and/or the controller 30 may be carried out by manually contacting the structural components, such as with a tool, or may be done with a mobile device that is in wireless communication with the controller 30 directly or through a local network. This is considered on-site testing or maintenance. In other embodiments, a remote connection is established between the controller 30 and a remote device that is not located at the elevator system 12 location to perform the testing in what is referred to as remote testing. The remote device is connected to the controller 30 via a network 32 or some other remote wireless connection, such as cellular. Such a remote device may be operated by a remote operator in some embodiments, with the remote operator not required to be "on-site."

Figure 3:
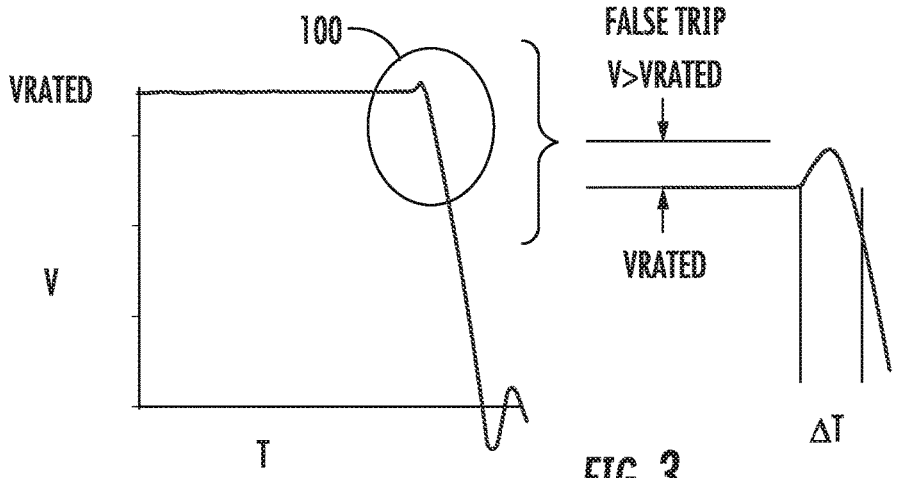
FIG. 3 is a plot of velocity vs. time during elevator operation.
Figure 4:
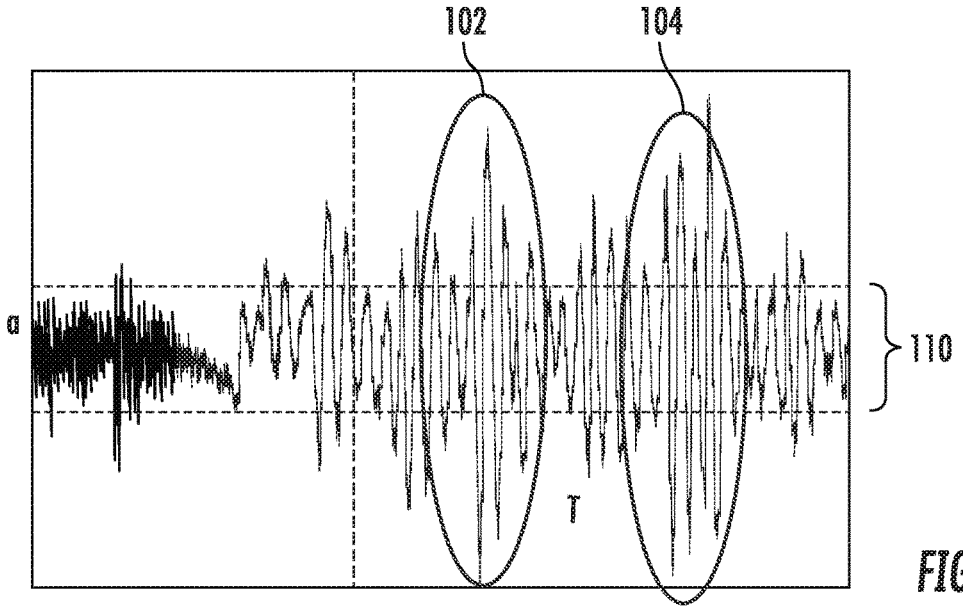
FIG. 4 is a plot of acceleration vs. time during elevator operation.

Referring now to FIGS. 3 and 4, velocity and/or acceleration profiles associated with actual use of the elevator system are illustrated. The data is obtained from electronic equipment that is part of, or associated with, the electronic safety actuator 22. The equipment utilized may be one or more sensors, such as an accelerometer or a speed sensor, for example. The electronic safety actuator equipment monitors changes in velocity and/or acceleration as a function of time, as illustrated. As shown, brief periods of time where a predetermined maximum condition is exceeded may be present during normal use of the elevator system.

FIG. 3 is a plot of velocity (V) of the elevator car 14 as a function of time (T) and shows a velocity at which the elevator car is rated for use, Vrated. As shown proximate region 100, exceeding of the rated velocity may occur for a number of reasons, including those discussed above, as well as a stopping process with an empty car in an upward direction or a full load in a downward direction is a scenario that may cause a false trip. Typically, exceeding a threshold velocity above the rated velocity would trigger the safety brakes, thereby resulting in a false trip. The current method utilizes an algorithm that takes into account the time in which the change in velocity occurs. In the illustrated embodiment, a threshold velocity is greater than the rated velocity. In some embodiments, the threshold velocity ranges from about 1.40 m/s to about 1.50 m/s and the rated velocity is about 1.0 m/s. If the threshold velocity is exceeded for any time, the safety brake deployment may occur in some embodiments, regardless of the amount of time in which the threshold velocity was exceeded. However, if the velocity is between Vrated and the threshold velocity, and occurs for less than a predetermined time period, ΔT, a false trip is avoided. The predetermined time period, ΔT, is sufficient to filter out unwanted safety brake actuation, but sufficient to meet code requirements. The predetermined time period may vary depending upon the particular application, but an example time period is about 0.040 seconds.

FIG. 4 is a plot of acceleration (a) of the elevator car 14 as a function of time (T) and illustrates an acceleration profile with multiple brief periods at 102 and 104 of operation outside of the acceptable acceleration range, the range represented with numeral 110. Such a situation may arise during bouncing of the elevator car 14, such as when a passenger is jumping in the elevator car. The oscillation shown in the profile of FIG. 4 results in the brief periods represented with numerals 102, 104. To avoid false tripping, the method and system require that the velocity and/or acceleration exceed the threshold(s) for a period of time known to be greater than the brief periods associated with passenger jumping, for example. In some embodiments, the required period of time is about 0.130 seconds. For example, if the acceleration is between a rated acceleration of about 0 $m/s^2$ when the car is travelling between floors and the threshold acceleration of about 2 $m/s^2$ to about 3 $m/s^2$ and occurs for less than a predetermined time period, ΔT if about 0.150 seconds, a false trip is avoided, but if the acceleration threshold is exceeded for any time, the safety brake deployment may occur in some embodiments. The predetermined time period, ΔT, is sufficient to filter out unwanted safety brake actuation, but sufficient to meet code requirements.

Figure 5:
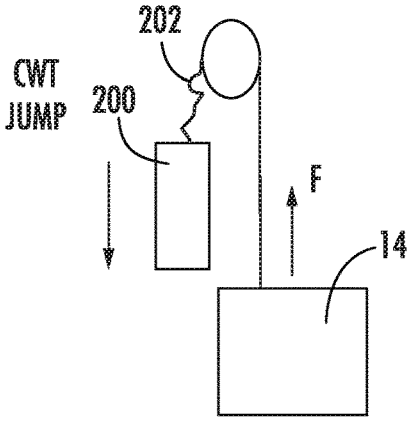
FIG. 5 is a force diagram illustrating the effect of a counterweight jump condition.

Referring now to FIG. 5, a counterweight 200 is shown during a "jump" condition. As shown, slack in the cable 202 connecting the counterweight 200 and the elevator car 14 may be present due to various reasons. Upon tensioning of the cable 202, the counterweight 200 may cause the safety brake 20, in the engaged and braking condition, to reset due to movement of the elevator car 14 upward. The forces associated with such a process are illustrated. The aforementioned process is described as a false safety reset. Equipment of the electronic safety actuator 22, such as an accelerometer, can study shock responses in the elevator car over time, and can mitigate conditions that would result in their undesirable engagement based on characteristics that are known to be associated with a false reset.

The embodiments described herein employ technology of the electronic safety actuator 22 to determine whether a velocity or acceleration is attributed to an actual free fall event or instead if a false trip or false reset condition is present. Additionally, the elevator system dynamically modifies the algorithms and parameters associated with brake actuation and resetting to reduce the likelihood of false trips and resets. Periodic reports can be sent to the customer and/or to a remote office to keep track of electronic safety actuator performance, which allows customer input into false trip and reset parameter modification.

The system and methods described herein reduce the likelihood of unwanted actuation and/or resetting of safety brakes using technology associated with electronic safety actuators. Such a problem may be present for numerous reasons. This is particularly problematic in countries where power outages occur regularly, thereby causing false trips in many cases. In certain countries, power outages may occur more than 20 times a day.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., a processor, apparatus or system) to perform one or more methodological acts as described herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the scope of the disclosure. Additionally, while various embodiments have been described, it is to be understood that aspects of the disclosure may include only some of the described embodiments. Accordingly, the disclosure is not to be seen as limited by the foregoing description, but is only limited by the scope of the appended claims.

What is claimed is:

1. A method of avoiding unnecessary safety brake actuation in an elevator system, the method comprising:

determining whether a true overspeed or overacceleration condition of an elevator car is present;

activating the electronic safety actuator if a true overspeed or overacceleration condition of the elevator car;

obtaining data with at least one sensor associated with an electronic safety actuator;

monitoring various operating conditions of the elevator car;

determining if the electronic safety actuator was activated during the various operating conditions; and determining if activation of the electronic safety actuator was a false trip.

2. The method of claim 1, wherein the data obtained by the at least one sensor is velocity data.

3. The method of claim 2, wherein the velocity data is compared to a threshold velocity to determine if the threshold velocity is exceeded or if the threshold velocity is exceeded for a predetermined period of time.

4. The method of claim 1, wherein the data obtained by the at least one sensor is acceleration data.

5. The method of claim 4, wherein the acceleration data is compared to a threshold acceleration to determine if the safety brake should be applied.

6. The method of claim 5, wherein the threshold acceleration must be exceeded for a predetermined period of time.

7. A method of avoiding unnecessary safety brake actuation in an elevator system, the method comprising:

determining whether a true overspeed or overacceleration condition of an elevator car is present; and avoiding activation of the electronic safety actuator if a true overspeed or overacceleration condition of the elevator car is not present.

8. The method of claim 7, further comprising:

obtaining data with at least one sensor associated with an electronic safety actuator;

monitor various operating conditions of the elevator car;

determine if the electronic safety actuator was activated during the various operating conditions;

determine if activation of the electronic safety actuator was a false trip; and update a data model based on the determination of whether the activation was a false trip.

9. The method of claim 8, wherein the data obtained by the at least one sensor is velocity data and the threshold condition is a threshold velocity.

10. The method of claim 9, wherein the velocity data is compared to a threshold velocity to determine if the threshold velocity is exceeded or if the threshold velocity is exceeded for a predetermined period of time.

11. The method of claim 8, wherein the data obtained by the at least one sensor is acceleration data and the threshold condition is a threshold acceleration.

12. The method of claim 8, wherein analyzing the data obtained with the at least one sensor is conducted at a remote site, the at least one sensor in operative communication with a processing device at the remote site.

13. The method of claim 8, wherein analyzing the data obtained with the at least one sensor is conducted on site by an individual.

14. A method of avoiding inadvertent resetting of a safety brake of an elevator system, the method comprising:

obtaining data with at least one sensor associated with an electronic safety actuator; and determining whether resetting of a safety brake is made based on an algorithm that compares the data obtained by the sensor(s) and a threshold condition, resetting of the safety brake occurring if the threshold condition is exceeded for equal to or greater than a predetermined amount of time.

15. The method of claim 14, wherein the data obtained by the at least one sensor is velocity data and the threshold condition is a threshold velocity.

16. The method of claim 14, wherein the data obtained by the at least one sensor is acceleration data and the threshold condition is a threshold acceleration.

17. The method of claim 14, further comprising:

analyzing the data obtained with the at least one sensor; and modifying the algorithm based on actual use of the safety brake.

18. The method of claim 17, wherein analyzing the data obtained with the at least one sensor is conducted at a remote site, the at least one sensor in operative communication with a processing device at the remote site.

19. The method of claim 17, wherein analyzing the data obtained with the at least one sensor is conducted on site by an individual.

20. The method of claim 1, further comprising updating a data model based on the determination of whether the activation was a false trip.

* * * * *